US011173592B2

(12) United States Patent
Furusawa et al.

(10) Patent No.: US 11,173,592 B2
(45) Date of Patent: Nov. 16, 2021

(54) WORK TOOL

(71) Applicant: MAKITA CORPORATION, Anjo (JP)

(72) Inventors: Masanori Furusawa, Anjo (JP); Akira Mizutani, Anjo (JP)

(73) Assignee: MAKITA CORPORATION, Anjo (JP)

( * ) Notice: Subject to any disclaimer, the term of this patent is extended or adjusted under 35 U.S.C. 154(b) by 273 days.

(21) Appl. No.: 16/511,043

(22) Filed: Jul. 15, 2019

(65) Prior Publication Data

US 2020/0016733 A1 Jan. 16, 2020

(30) Foreign Application Priority Data

Jul. 14, 2018 (JP) ..... JP2018-133773

(51) Int. Cl.
*B25F 3/00* (2006.01)
*B25F 5/02* (2006.01)

(52) U.S. Cl.
CPC . *B25F 3/00* (2013.01); *B25F 5/02* (2013.01)

(58) Field of Classification Search
CPC ..... B25F 3/00; B25F 5/02; B24B 23/04
See application file for complete search history.

(56) References Cited

U.S. PATENT DOCUMENTS 9,555,554 B2 * 1/2017 Thorson ..... B24B 45/006
10,549,396 B2 * 2/2020 Matsunaga ..... H02P 7/245
2003/0220058 A1 * 11/2003 Pollak ..... B24B 47/10 451/357
2009/0197514 A1 * 8/2009 Peisert ..... B24B 23/04 451/356
2013/0082449 A1 * 4/2013 Bernardi ..... B24B 23/04 279/141

(Continued)

FOREIGN PATENT DOCUMENTS

EP 2799188 A1 11/2014
JP 2013-158879 A 8/2013
WO 2013/065614 A1 5/2013

OTHER PUBLICATIONS

Nov. 28, 2019 Search Report issued in European Patent Application No. 19185257.3.

*Primary Examiner* — Eyamindae C Jallow
(74) *Attorney, Agent, or Firm* — Oliff PLC

(57) ABSTRACT

A work tool includes a spindle, a clamp shaft, a holding member, an engagement member and a first biasing member. The holding member has a pass-through part. The engagement member is rotatable around a driving axis relative to the holding member between a first position in which the engagement member is allowed to pass through the pass-through part and a second position in which the engagement member is engaged with the holding member. The engagement member allows the clamp shaft to move in an up-down direction relative to the holding member when located in the first position, and to prevent the clamp shaft from moving downward relative to the holding member when located in the second position. The holding member is configured to fixedly hold the clamp shaft relative to the spindle while being biased upward by the first biasing member, with the engagement member in the second position.

20 Claims, 11 Drawing Sheets

(56) References Cited

U.S. PATENT DOCUMENTS

| | | | | |
|---|---|---|---|---|
| 2013/0270780 | A1* | 10/2013 | Emi | B24B 23/04 279/141 |
| 2015/0042052 | A1 | 2/2015 | Furusawa et al. | |
| 2017/0080545 | A1* | 3/2017 | Furusawa | B27B 19/006 |
| 2017/0225316 | A1* | 8/2017 | Iwakami | B25F 5/006 |

* cited by examiner

WORK TOOL

CROSS-REFERENCE TO RELATED APPLICATION

The present application claims priority to Japanese patent application No. 2018-133773 filed on Jul. 14, 2018, the contents of which are fully incorporated herein by reference.

TECHNICAL FIELD

The present disclosure relates to a work tool which is configured to perform an operation on a workpiece by driving a tool accessory.

BACKGROUND ART

A work tool is known which performs an operation on a workpiece by transmitting the output of a motor to a spindle and thereby driving a tool accessory fixed to a lower end of the spindle. In some of such work tools, a tool accessory can be fixed to a spindle without the need for using an auxiliary tool such as a spanner. For example, Japanese unexamined laid-open patent publication No. 2013-158879 discloses a work tool which is configured to fixedly hold a clamp shaft relative to a spindle while the clamp shaft is biased upward, and clamp a tool accessory between a lower end portion of the spindle and a lower end portion of the clamp shaft.

SUMMARY

In the work tool disclosed in Japanese unexamined laid-open patent publication No. 2013-158879, a ball(s) or a clamp member(s) which is (are) engageable with an upper end portion of the clamp shaft is employed to fixedly hold the clamp shaft relative to the spindle. Therefore, in this work tool, a space is required for allowing the ball(s) or the clamp member(s) to move in a radial direction.

Accordingly, it is an object of the present disclosure to provide a rational structure for fixedly holding a clamp shaft relative to a spindle in a work tool.

According to one aspect of the present disclosure, a work tool is provided which is configured to perform an operation on a workpiece by driving a tool accessory. The work tool includes a spindle, a clamp shaft, a holding member, an engagement member and a first biasing member.

The spindle is supported to be rotatable around a driving axis which defines an up-down direction of the work tool. Further, the spindle has a first clamp part on its lower end portion. The clamp shaft has a shaft part and a second clamp part. The shaft part is configured to be coaxially inserted into the spindle. The second clamp part is provided on a lower end portion of the shaft part and configured to clamp the tool accessory in cooperation with the first clamp part. The holding member has a pass-through part. The engagement member is configured to be rotatable around the driving axis relative to the holding member between a first position and a second position. The first position is a position in which the engagement member is allowed to pass through the pass-through part. The second position is a position in which the engagement member is not allowed to pass through the pass-through part and is engaged with the holding member. The first biasing member is configured to bias the holding member. Further, the engagement member is configured to allow the clamp shaft to move in the up-down direction relative to the holding member when the engagement member is located in the first position, and to prevent the clamp shaft from moving downward relative to the holding member when the engagement member is located in the second position. The holding member is configured to fixedly hold the clamp shaft relative to the spindle while being biased upward by the first biasing member, with the engagement member in the second position.

It is noted that the work tool according to the present aspect generally refers to a work tool configured to drive the tool accessory which is fixed by the first clamp part and the second clamp part to the spindle which is rotatable around the driving axis. Example of such a work tool may include an oscillating tool and a rotary tool. The oscillating tool refers to a work tool configured to oscillatorily drive the tool accessory by the spindle being reciprocally rotated around the driving axis within a specified angle range. The rotary tool refers to a work tool (such as a grinder, a sander and a polisher) configured to rotationally drive the tool accessory by the spindle being rotated around the driving axis. Further, the pass-through part of the holding shaft can also be referred to as a space or a passage which is at least partially closed in the holding shaft. Typically, the pass-through part may be configured as a through hole or a recess.

In one aspect of the present disclosure, the engagement member may be integrally formed with the shaft part of the clamp shaft. It is noted that the engagement member may be integrally formed on any portion of the shaft part, but may preferably be provided on an upper end portion (that is, an end portion on the side opposite to the first clamp part) of the shaft part.

In one aspect of the present disclosure, the holding member may have a lower wall part, and the pass-through part may be configured as a through hole extending through the lower wall part in the up-down direction and having a closed periphery. In this case, the engagement member may be configured to come into surface contact with a portion of an upper surface of the lower wall part when the engagement member is located in the second position.

In one aspect of the present disclosure, the holding member may be configured to move relative to the spindle between a holding position and a releasing position. The holding position is a position in which the holding member fixedly holds the clamp shaft relative to the spindle. The releasing position is a position in which the holding member allows removal of the clamp shaft from the spindle. Further, the holding member may be configured to be held by a biasing force of the first biasing member when the holding member is located in either the holding position or the releasing position. Further, the holding member may be configured to move toward the holding position while rotating around the driving axis, when the shaft part is inserted into the spindle with the holding member in the releasing position and the engagement member in the first position, thereby causing the engagement member to relatively move to the second position.

In one aspect of the present disclosure, the holding position and the releasing position may be different from each other both in the up-down direction and in a circumferential direction around the driving axis.

In one aspect of the present disclosure, the spindle may have an inclined groove in its outer periphery. The inclined groove may be inclined relative to the driving axis. Further, the holding member may have a protruding part which is disposed within the inclined groove. Further, the first biasing member may have a function as a torsion spring and may be configured to bias and rotate the holding member around the driving axis to thereby engage the protruding part with the inclined groove and hold the holding member in the holding position.

In one aspect of the present disclosure, the holding member may have a roller rotatably mounted onto the protruding part, and the protruding part may be engaged with the inclined groove via the roller.

In one aspect of the present disclosure, the first biasing member may be a coil spring having both functions of a compression spring and a torsion spring. Further, the first biasing member may be configured to bias the holding member downward relative to the spindle by a restoring force corresponding to compression of the coil spring when the holding member is located in the releasing position, and to bias the holding member upward relative to the spindle by a restoring force corresponding to torsion of the coil spring when the holding member is located in the holding position.

In one aspect of the present disclosure, the spindle may have a downward groove extending downward from a lower end of the inclined groove, and the protruding part may be configured to be engaged with the downward groove when the holding member is located in the releasing position, thereby preventing the holding member from rotating relative to the spindle.

In one aspect of the present disclosure, the spindle may have a downward groove extending downward from a lower end of the inclined groove, and the protruding part may be configured to be moved downward along the downward groove by the restoring force corresponding to compression of the first biasing spring when the protruding part is moved to a portion connecting from the inclined groove to the downward groove, thereby guiding the holding member downward.

In one aspect of the present disclosure, the work tool may further include an operation member configured to move from an initial position according to a user's operation of the operation member to rotate the holding member around the driving axis, thereby moving the holding member from the holding position to the releasing position. The second biasing member may be configured to bias the operation member toward the initial position. Further, the second biasing member may be configured to bias the operation member to be returned to the initial position in a state in which the holding member is held in the releasing position.

In one aspect of the present disclosure, the operation member may have an abutment part configured to abut on the holding member and rotate the holding member, and the holding member may be configured to be separated from the abutment part when located in the releasing position.

In one aspect of the present disclosure, the engagement member may have a pair of flat surfaces opposed in parallel to each other across the driving axis, and the pass-through part may have a sectional shape substantially matching the engagement member.

In one aspect of the present disclosure, the work tool may further include an elastic member which is disposed on an outer periphery of the shaft part and configured to come into frictional contact with an inner peripheral surface of the spindle when the shaft part is placed inside the spindle.

In one aspect of the present disclosure, the spindle may include a rotation preventing part configured to prevent the clamp shaft from rotating around the driving axis relative to the spindle.

DETAILED DESCRIPTION OF THE EMBODIMENTS

Figure 1:
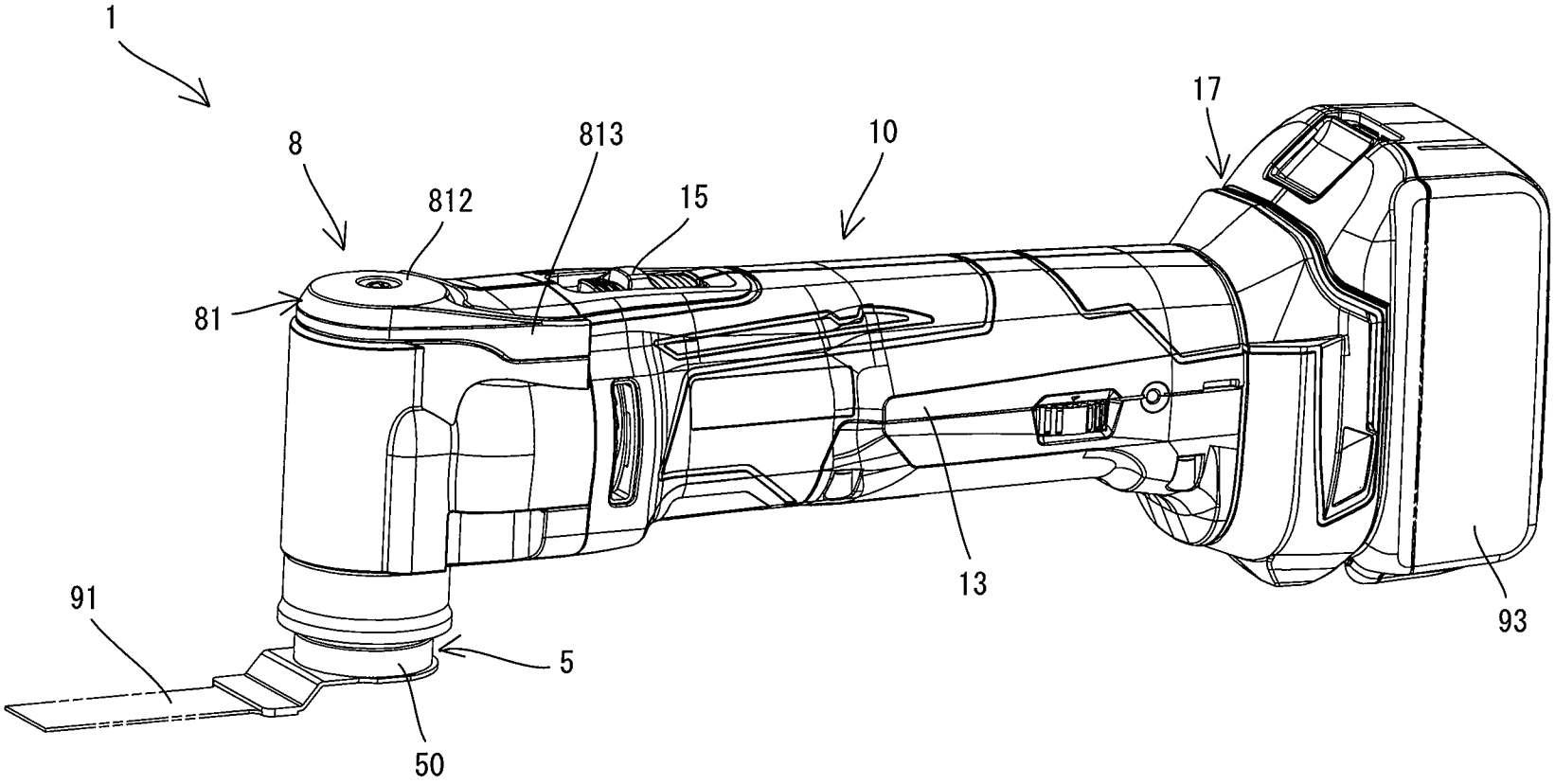
FIG. 1 is a perspective view showing an overall structure of an oscillating tool.

An embodiment is now described with reference to the drawings. In the following embodiment, as an example of a work tool, an electric oscillating tool 1 (see FIG. 1) is described which performs an operation on a workpiece (not shown) by oscillatorily driving a tool accessory 91. Plural kinds of tool accessories such as a blade, a scraper, a grinding pad and a polishing pad are available as the tool accessories 91 which can be mounted to the oscillating tool 1. A user can select any one of the tool accessories 91 which is suitable for a desired processing operation such as cutting, scraping, grinding and polishing, attach the tool accessory 91 to the oscillating tool 1, and then perform the processing operation. In the drawings to be referenced below, a blade attached to the oscillating tool 1 is shown as an example of the tool accessory 91.

Figure 2:
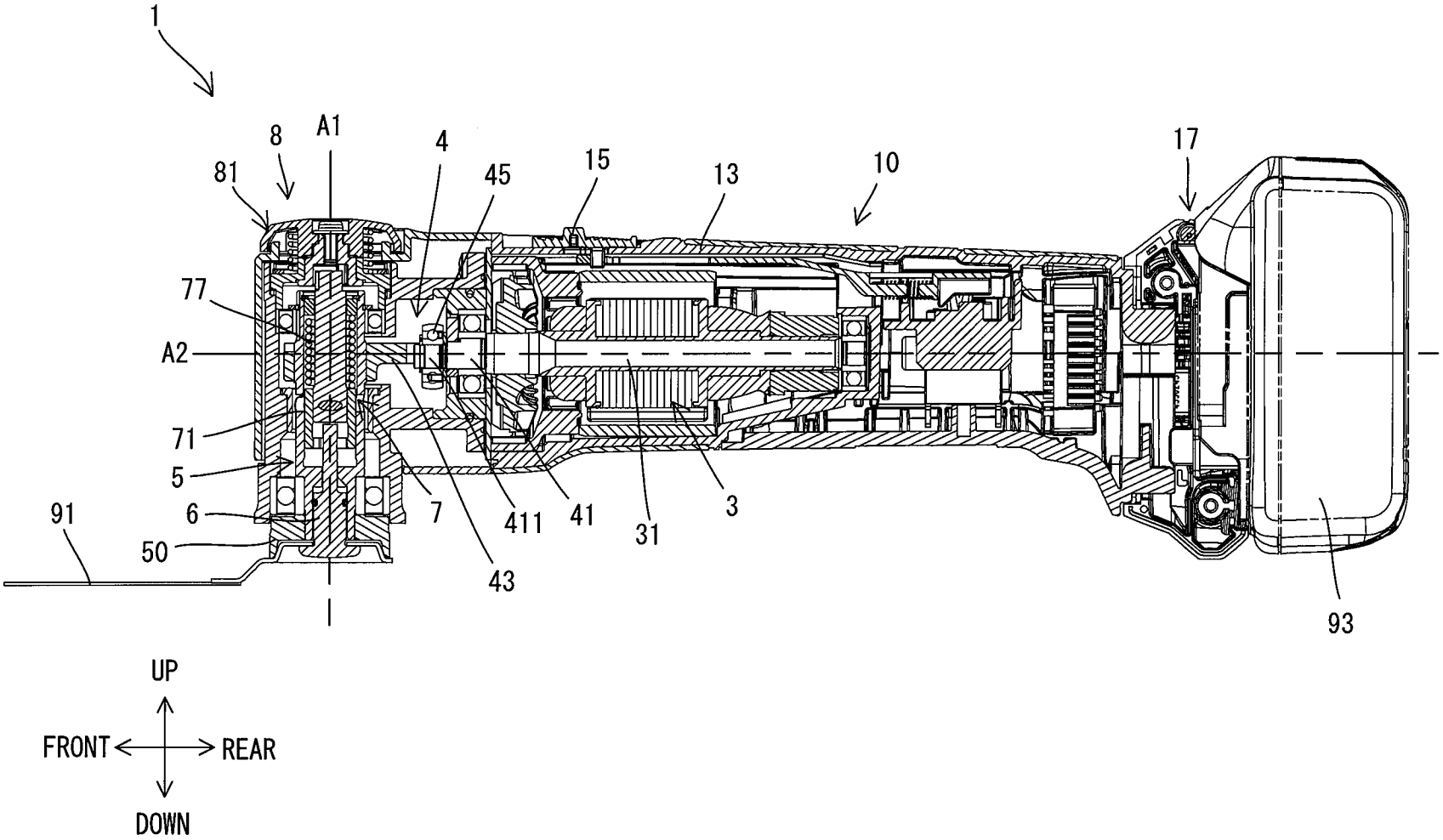
FIG. 2 is a sectional view showing the oscillating tool when a holding shaft is located in a clamp position.

First, a general structure of the oscillating tool 1 is described. As shown in FIGS. 1 and 2, the oscillating tool 1 includes an elongate housing (also referred to as a tool body) 10. A spindle 5, a motor 3 and a driving mechanism 4 etc. are housed within the housing 10. The spindle 5 is housed in one end portion in a longitudinal direction of the housing 10. Further, the spindle 5 is disposed along a driving axis A1 which crosses (specifically, orthogonally crosses) a longitudinal axis of the housing 10. One axial end portion of the spindle 5 protrudes from the housing 10 and is exposed to the outside. The tool accessory 91 can be removably mounted to this exposed portion. Further, a battery 93 for supplying electric power to the motor 3 can be removably mounted to the other end portion of the housing 10 in the longitudinal direction. The spindle 5 may be reciprocally rotated within a specified angle range around the driving axis A1 by power of the motor 3 which is transmitted via the driving mechanism 4. Thus, the tool accessory 91 mounted to the spindle 5 may be oscillated within the specified angle range to thereby perform a processing operation on a workpiece.

In the following description, for convenience sake, relating to directions of the oscillating tool 1, a direction of the driving axis A1 (also referred to as a driving-axis-A1 direction) is defined as an up-down direction. In the up-down direction, the side of one axial end portion of the spindle 5 to which the tool accessory 91 may be mounted is defined as a lower side, while the opposite side is defined as an upper side. A direction which is orthogonal to the driving axis A1 and which corresponds to the longitudinal direction of the housing 10 is defined as a front-rear direction. In the front-rear direction, the side of one end portion of the housing 10 in which the spindle 5 is housed is defined as a front side, while the side of the other end portion on which the battery 93 may be mounted is defined as a rear side. Further, a direction which is orthogonal to both the driving axis A1 and the longitudinal axis of the housing 10 is defined as a right-left direction.

The structure of the oscillating tool 1 is now described in further detail.

First, the housing 10 is described. As shown in FIG. 2, the housing 10 is an elongate housing body which forms an outer shell of the oscillating tool 1. The spindle 5 is housed in a front end portion of the housing 10. The motor 3 is housed in a generally central portion of the housing 10. The driving mechanism 4 is housed between the motor 3 and the spindle 5. The central portion of the housing 10 forms a grip part 13 to be held by a user. A slide switch 15 is disposed on a top surface of the housing 10. The slide switch 15 is configured to be operated by the user holding the grip part 13. In the present embodiment, when the switch 15 is switched to an on-position, the motor 3 is driven. A battery mounting part 17, to which the rechargeable battery 93 can be removably mounted, is provided on a rear end portion of the housing 10. It is noted that the structures of the battery 93 and the battery mounting part 17 are well known and therefore not described here.

The motor 3, the driving mechanism 4, the spindle 5 and other internal mechanisms are now described.

As shown in FIG. 2, the motor 3 is disposed such that a rotation axis A2 of a motor shaft 31 orthogonally crosses the driving axis A1 of the spindle 5. Specifically, the rotation axis A2 extends in the front-rear direction along the longitudinal axis of the housing 10.

The structure of the driving mechanism 4 is now described. The driving mechanism 4 is configured to reciprocally rotate the spindle 5 within a specified angle range around the driving axis A1 by power of the motor 3. As shown in FIG. 2, the driving mechanism 4 of the present embodiment includes an eccentric shaft 41, an oscillating arm 43 and a drive bearing 45. The driving mechanism 4 having such a structure is well known and therefore only briefly described here. The eccentric shaft 41 is connected to the motor shaft 31 and has an eccentric part 411 which is eccentric to the rotation axis A2. The drive bearing 45 is fitted onto an outer periphery of the eccentric part 411. The oscillating arm 43 connects the drive bearing 45 and the spindle 5. One end portion of the oscillating arm 43 is annularly shaped and fixed to an outer periphery of the spindle 5. The other end portion of the oscillating arm 43 is bifurcated and disposed to abut on an outer periphery of the drive bearing 45 from the right and left.

Figure 3:
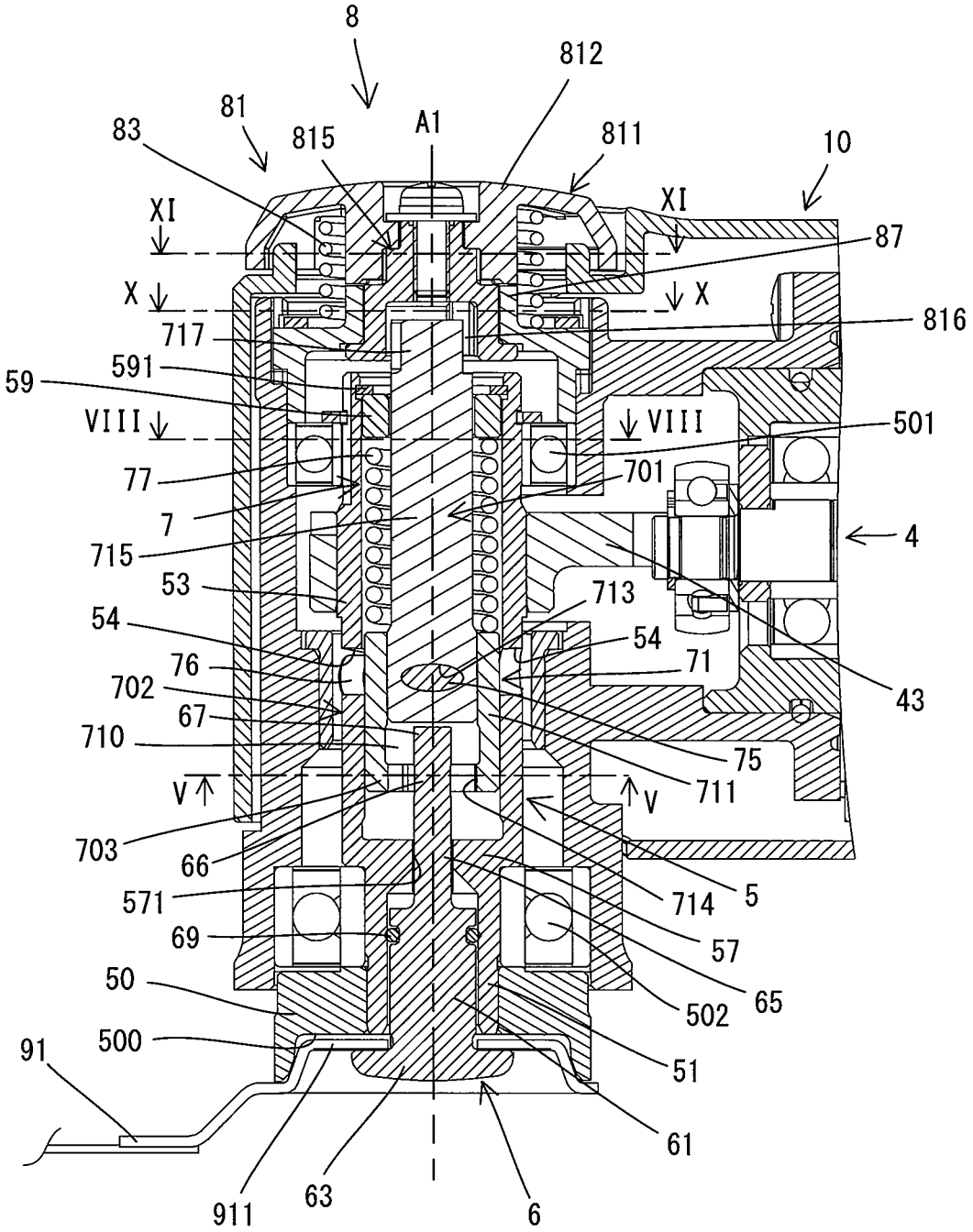
FIG. 3 is a partial, enlarged view of FIG. 2.

The structure of the spindle 5 is now described. As shown in FIG. 3, the spindle 5 is a hollow circular cylindrical member extending in the up-down direction. The spindle 5 is supported within the front end portion of the housing 10 so as to be rotatable around the driving axis A1. More specifically, upper and lower end portions of the spindle 5 are respectively supported by two bearings 501 and 502 which are fixed to the housing 10. The one end portion of the oscillating arm 43 is fixed to the outer periphery of the spindle 5 between the bearings 501 and 502. The lower end portion (a portion below the bearing 502) of the spindle 5 is exposed from the housing 10 to the outside. A clamp shaft 6 (specifically, a shaft part 61), which will be described later, can be inserted into the spindle 5 through a lower end opening of the spindle 5.

A flange-like tool mounting part 50 is provided on the lower end portion of the spindle 5 and protrudes outward in a radial direction of the spindle 5. The tool accessory 91 may be removably mounted to the tool mounting part 50 via the clamp shaft 6. In the present embodiment, a recess 500 is formed in a lower end portion of the tool mounting part 50. The recess 500 is recessed upward. Each of the tool accessories 91 (such as a blade, a scraper, a grinding pad and a polishing pad) which can be mounted to the oscillating tool 1 of the present embodiment has a protruding part 911 which can be fitted in the recess 500. The recess 500 and the protruding part 911 have respective inclined surfaces which are inclined relative to the driving axis A1. When the protruding part 911 is fitted in the recess 500, these inclined surfaces abut on each other and function as power transmission surfaces. In the present embodiment, with these inclined surfaces in abutment with each other, the tool accessory 91 may be clamped by the tool mounting part 50 and a clamp head 63 of the clamp shaft 6 and thereby fixed to the spindle 5. Fixing and releasing the tool accessory 91 to and from the spindle 5 will be described in detail later.

The lower end portion of the spindle 5 is a portion into which the shaft part 61 of the clamp shaft 6 may be inserted. The lower end portion of the spindle 5 thus has an inner diameter slightly larger than the diameter of the shaft part 61. A portion of the spindle 5 other than the lower end portion (i.e. a portion extending upward from the lower end portion) has an inner diameter larger than that of the lower end portion. In the following description, the lower end portion of the spindle 5 which has a smaller inner diameter is referred to as a small-diameter part 51, and the other portion of the spindle 5 which has a larger inner diameter is referred to as a large-diameter part 53. A holding mechanism 7 for fixedly holding the clamp shaft 6 relative to the spindle 5 is disposed within the larger diameter part 53.

Figure 4:
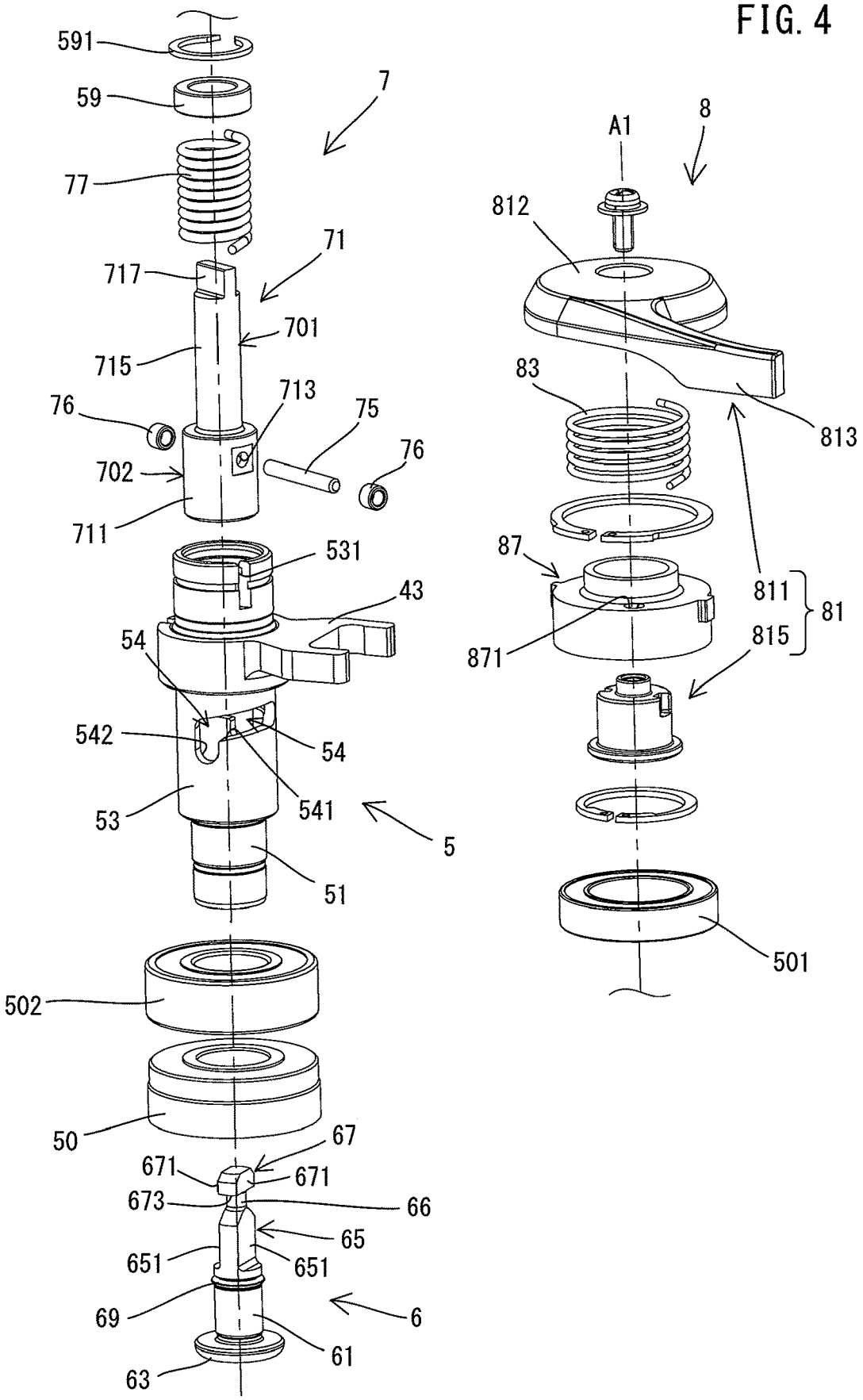
FIG. 4 is an exploded perspective view showing a clamp shaft, a spindle, a holding mechanism and a releasing mechanism.

As shown in FIGS. 3 and 4, the large-diameter part 53 has a pair of pin engagement grooves 54. The pin engagement grooves 54 are through holes extending through the spindle 5 in the radial direction, and have a rotational symmetry of 180 degrees (order 2 symmetry) relative to the driving axis A1. Each of the pin engagement grooves 54 includes a first part 541 and a second part 542. The first part 541 extends obliquely relative to the driving axis A1 and also to an imaginary plane orthogonal to the driving axis A1. The second part 542 extends in the driving-axis-A1 direction (i.e. in the up-down direction). In the present embodiment, an inclination angle of the first part 541 relative to the imaginary plane orthogonal to the driving axis A1 is set to about 7 to 10 degrees. Both end portions (specifically, rollers 76) of an engagement pin 75 to be described later are respectively engaged with the pin engagement grooves 54.

Further, as shown in FIG. 3, a partition wall 57 is provided between the small-diameter part 51 and the large-diameter part 53 in the up-down direction to demarcate these parts. A positioning hole 571 is formed in a central portion of the partition wall 57. The positioning hole 571 extends through the partition wall 57 in the up-down direction. The positioning hole 571 is configured as an elongated hole which is longer in the right-left direction, and front and rear ends of the positioning hole 571 are defined by a pair of flat surfaces which are parallel to each other.

The structure of the clamp shaft 6 is now described. The clamp shaft 6 of the present embodiment is an elongate member which is configured to be removably mounted to the spindle 5. In the following description, directions of the clamp shaft 6 are described based on the state in which the clamp shaft 6 is inserted into the spindle 5. As shown in FIGS. 3 and 4, the clamp shaft 6 of the present embodiment includes the shaft part 61, the clamp head 63, a positioning part 65, a neck part 66 and a locking part 67.

The shaft part 61 has a circular columnar shape. The shaft part 61 is a portion of the clamp shaft 6 which may be inserted into the small-diameter part 51 of the spindle 5, coaxially with the spindle 5. An annular elastic member (so-called O-ring) 69 is fitted in an annular groove formed in an outer periphery of an upper end portion of the shaft part 61. When the shaft part 61 is inserted into the small-diameter part 51, the elastic member 69 generates a frictional force by contact (comes in frictional contact) with an inner peripheral surface of the small-diameter part 51. With such a structure, the elastic member 69 can prevent the clamp shaft 6 from dropping by its own weight.

The clamp head 63 is a flange-like portion protruding radially outward from a lower end portion of the shaft part 61. The clamp head 63 is configured to clamp the tool accessory 91 in cooperation with the tool mounting part 50 while being disposed below the tool mounting part 50.

The positioning part 65 is an elongate portion extending upward from the upper end of the shaft part 61 and coaxially with the shaft part 61. The positioning part 65 has a cross-sectional shape substantially matching the shape of the positioning hole (elongated hole) 571 of the spindle 5. Specifically, an outer peripheral surface of the positioning part 65 includes a pair of flat surfaces 651 opposed in parallel to each other across an axis (the driving axis A1). The distance between the flat surfaces 651 is set to be slightly smaller than the width (the distance between a pair of flat surfaces defining front and rear ends) of the positioning hole 571 (see FIG. 3). Further, the maximum diameter of the positioning part 65 is set to be substantially equal to the diameter of the shaft part 61 and to be slightly smaller than the maximum diameter of the positioning hole 571.

The neck part 66 is a portion which extends upward from the positioning part 65 and coaxially with the shaft part 61. The neck part 66 has a circular columnar shape having a smaller diameter than the shaft part 61. The diameter of the neck part 66 is set to be substantially equal to the distance between the flat surfaces 651 of the positioning part 65 and to be slightly smaller than the width of the positioning hole 571.

The locking part 67 is a portion which is connected to an upper end of the neck part 66. The locking part 67 has a generally rectangular block-like shape. The maximum length of the locking part 67 in a direction orthogonal to the driving axis A1 is larger than the diameter of the neck part 66, and both end portions of the locking part 67 protrude radially outward from the neck part 66. The locking part 67 has a shape which substantially matches the shape of the positioning part 65 when viewed from above. Specifically, an outer peripheral surface (side surfaces) of the locking part 67 includes a pair of flat surfaces 671 opposed in parallel to each other across the axis (the driving axis A1). The distance between the flat surfaces 671 of the locking part 67 is set to be equal to the distance between the flat surfaces 651 of the positioning part 65 and to be slightly smaller than the width of the positioning hole 571. The maximum diameter of the locking part 67 is set to be substantially equal to the diameter of the shaft part 61 and to be slightly smaller than the maximum diameter of the positioning hole 571.

With such a structure, the positioning part 65 and the locking part 67 are allowed to pass through the positioning hole 571 only when located in a specific position relative to the spindle 5 in a circumferential direction around the driving axis A1. Further, although described in detail later, when the positioning part 65 is inserted into the positioning hole 571, the flat surfaces defining the front and rear ends of the positioning hole 571 face the flat surfaces 651 of the positioning part 65, so that the clamp shaft 6 is prevented from rotating around the driving axis A1 (see FIG. 3). In other words, when the positioning part 65 is inserted into the positioning hole 571, the clamp shaft 6 is positioned and held (retained) in the circumferential direction around the driving axis A1.

The structure of the holding mechanism 7 disposed within the large-diameter part 53 of the spindle 5 is now described. The holding mechanism 7 is a mechanism which is configured to fixedly hold (retain) the clamp shaft 6 relative to the spindle 5 while biasing the clamp shaft 6 upward. As shown in FIGS. 3 and 4, the holding mechanism 7 of the present embodiment mainly includes a holding shaft 71, the engagement pin 75 and a biasing spring 77.

The holding shaft 71 is an elongate member extending in the up-down direction along the driving axis A1, and disposed coaxially with the spindle 5 within the large-diameter part 53 of the spindle 5. The holding shaft 71 is disposed to be movable in the up-down direction and rotatable around the driving axis A1, relative to the spindle 5. The holding shaft 71 includes a large-diameter part 711, a small-diameter part 715 and a lever engagement part 717.

The large-diameter part 711 forms a lower end portion of the holding shaft 71. The large-diameter part 711 has an outer diameter which is generally equal to the inner diameter of the large-diameter part 53 of the spindle 5 and can slide along an inner peripheral surface of the large-diameter part 53. The small-diameter part 715 extends upward from the large-diameter part 711 and has a smaller diameter than the large-diameter part 711. The lever engagement part 717 protrudes upward from the small-diameter part 715 and forms an upper end portion of the holding shaft 71. The lever engagement part 717 has a rectangular cross-section. It is noted that the small-diameter part 715 and the lever engagement part 717 are formed as one base shaft 701, and the large-diameter part 711 is formed by a bottomed cylindrical member 702 being fixed onto a lower end portion of the base shaft 701 by press-fitting. At the time of press-fitting, a bottom wall part (lower wall part) 703 of the cylindrical member 702 is arranged at a position spaced apart downward from a lower end of the base shaft 701, so that a space 710 is formed within a lower end portion of the holding shaft 71 (see FIG. 3). The space 710 allows the locking part 67 of the clamp shaft 6 to be inserted into the space 710 and rotate around the driving axis A1 relative to the holding shaft 71 within the space 710.

Figure 5:
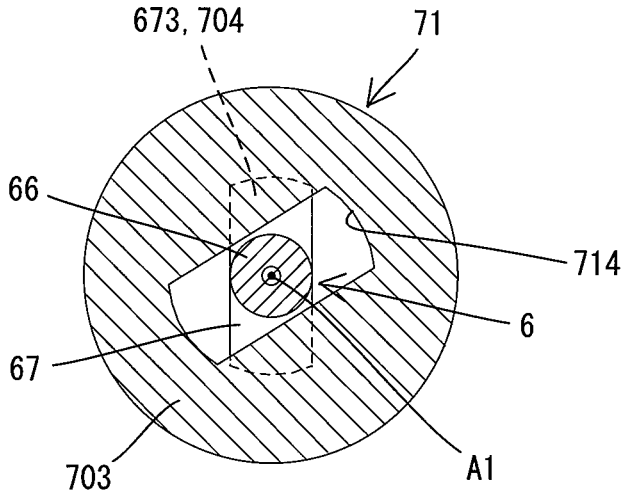
FIG. 5 is a sectional view taken along line V-V in FIG. 3, showing the clamp shaft and the holding shaft for illustrating the positional relationship between the clamp shaft and the holding shaft when a locking part is located in a lock position.
Figure 6:
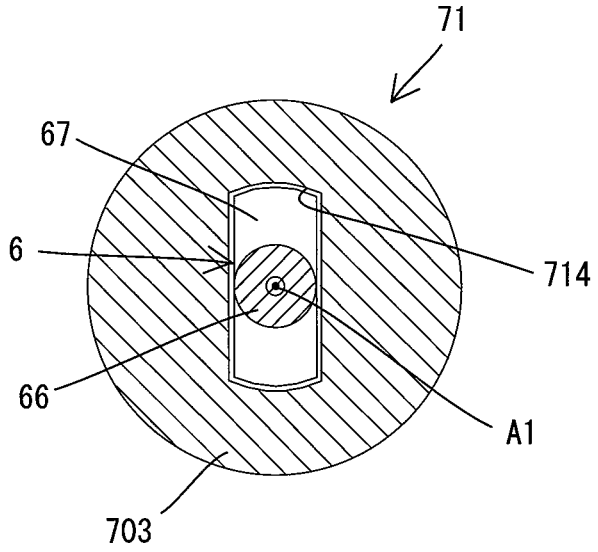
FIG. 6 is a sectional view similar to FIG. 5, for illustrating the positional relationship between the clamp shaft and the holding shaft when the locking part is located in an unlock position.

Further, as shown in FIGS. 3 and 5, a locking hole 714 is formed in the bottom wall part 703. The locking hole 714 is a through hole extending through the bottom wall part 703 in the up-down direction and having a closed periphery. The locking hole 714 is configured as an elongated hole having substantially the same cross-sectional shape as the positioning hole 571 of the spindle 5 which is described above. Specifically, the locking hole 714 is also configured to be slightly larger than the locking part 67 and to have a cross-sectional shape matching the locking part 67. Therefore, as shown in FIG. 6, the locking part 67 is allowed to pass through the locking hole 714 in the up-down direction only when located in a specific position relative to the holding shaft 71 in the circumferential direction around the driving axis A1.

When the locking part 67 and the holding shaft 71 rotate relative to each other within a specific angle range after the locking part 67 is inserted through the locking hole 714 and placed within the space 710, as shown in FIG. 5, the locking part 67 is not allowed to pass through the locking hole 714 and is engaged with the holding shaft 71. Specifically, an upper surface 704 of the bottom wall part 703 is partially engaged (specifically, a region of the upper surface 704 around the locking hole 714 are engaged) in surface contact with a lower surface 673 of the locking part 67. In other words, the region of the upper surface 704 of the bottom wall part 703 around the locking hole 714 serves as an engagement surface (receiving surface). Thus, the clamp shaft 6 is connected to the holding shaft 71 by engagement between the locking part 67 and the holding shaft 71. In terms of the relationship between the locking part 67 and the locking hole 714 of the present embodiment, the locking part 67 can be engaged with the holding shaft 71 if the rotation angle is larger than 0 degree and smaller than 180 degrees. For more reliable engagement, however, the rotation angle is preferably in a range from 15 to 90 degrees, and more preferably 30 to 90 degrees. In consideration of the balance between operation efficiency of the locking part 67 and reliable engagement, the rotation angle is further preferably in a range from about 30 to 60 degrees.

In the following description, as for the position of the clamp shaft 6 (the locking part 67) relative to the holding shaft 71 in the circumferential direction, a position (shown in FIG. 6) in which the locking part 67 is allowed to pass through the locking hole 714 is referred to as an unlock position, and a position (shown, for example, in FIG. 5) in which the locking part 67 is not allowed to pass through the locking hole 714 and is engageable with the holding shaft 71 is referred to as a lock position. In the present embodiment, the relative positional relationship between the holding shaft 71 and the clamp shaft 6 (the locking part 67) in the circumferential direction changes in response to an operation of a release lever 81 to be described later, or in response to insertion of the clamp shaft 6 into the holding shaft 71. These features will be described in detail later.

Figure 7:
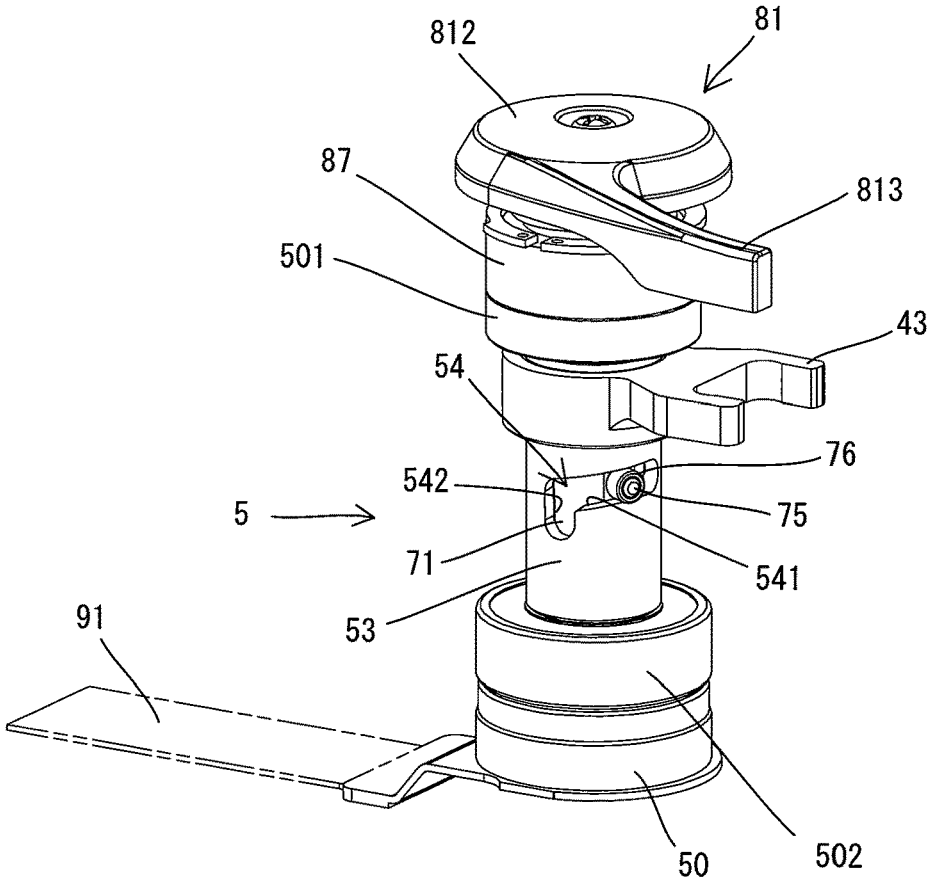
FIG. 7 is a perspective view showing the spindle, the holding shaft and a release lever when the holding shaft is located in the clamp position.

As shown in FIG. 4, a through hole 713 is formed in the large-diameter part 711 (specifically, in a portion above the space 710). The through hole 713 extends through the large-diameter part 711 in a radial direction (a direction orthogonal to the driving axis A1). The engagement pin 75 is a circular columnar member having a small diameter, and is fitted into the through hole 713. The engagement pin 75 is longer than the outer diameter of the large-diameter part 711 and the both axial end portions of the engagement pin 75 protrude from the large-diameter part 711 to the outside. A roller 76 is rotatably supported on each of the end portions of the engagement pin 75. As shown in FIG. 7, the engagement pin 75 is engaged with the pin engagement grooves 54 via the rollers 76.

Figure 8:
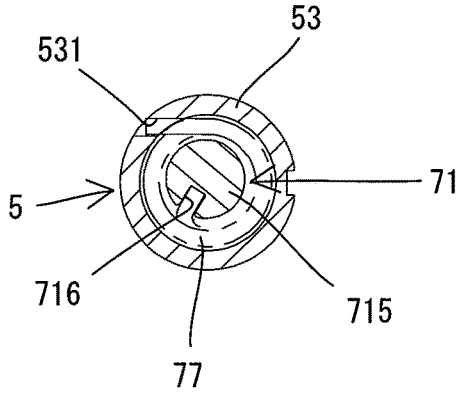
FIG. 8 is a sectional view taken along line in FIG. 3, showing the holding shaft, a biasing spring and the spindle.

In the present embodiment, a coil spring having both functions of a compression spring and a torsion spring is employed as the biasing spring 77. As shown in FIGS. 3 and 4, the biasing spring 77 is mounted onto the small-diameter part 715 of the holding shaft 71 and extends in the up-down direction. As shown in FIG. 8, a lower end portion (actuation end) of the biasing spring 77 is locked in a locking groove 716 formed in the holding shaft 71, while an upper end portion (fixed end) of the biasing spring 77 is locked in a locking groove 531 formed in the spindle 5. The locking groove 716 is formed in the small-diameter part 715 and extends in the up-down direction (see FIG. 9). The locking groove 531 is formed in an upper end portion of the large-diameter part 53 (see FIG. 4). A spring receiving member 59 having a circular cylindrical shape is disposed on the upper side of the biasing spring 77. Further, as shown in FIG. 3, the spring receiving member 59 is fitted in the large-diameter part 53 and prevented from moving upward by a retaining ring 591.

As shown in FIGS. 3 and 7, the holding mechanism 7 is assembled to the spindle 5 while the biasing spring 77 is compressed between an upper end of the large-diameter part 711 of the holding shaft 71 and a lower end of the spring receiving member 59 and twisted in a clockwise direction when viewed from above (in other words, the biasing spring 77 is under load in the axial direction and the twisted direction). Thus, the holding shaft 71 is biased downward and in a counterclockwise direction when viewed from above. Further, the engagement pin 75 is engaged with the first parts 541 (specifically, inclined surfaces each defining the first part 541) of the pin engagement grooves 54 via the rollers 76 at a position where the axial force and the torsional force are balanced, so that the holding shaft 71 is prevented from moving in the axial direction and rotating around the driving axis A1 relative to the spindle 5. At this time, the holding shaft 71 is held in a state of being biased upward by the torsional force of the biasing spring 77. In the following description, this position of the holding shaft 71 is referred to as a clamp position.

When the holding shaft 71 is located in the clamp position, the clamp shaft 6 connected to the holding shaft 71 via the locking part 67 is fixedly held (retained) relative to the spindle 5 while being biased upward, and the tool accessory 91 is clamped by the tool mounting part 50 and the clamp head 63. Further, when the holding shaft 71 is located in the clamp position, the locking part 67 is slightly separated downward from the lower end of the base shaft 701.

Further, as shown in FIG. 3, in the present embodiment, a releasing mechanism 8 is provided on the upper side of the spindle 5. The releasing mechanism 8 is configured to rotate the holding shaft 71 around the driving axis A1. Although described in detail later, the clamp shaft 6 is allowed to be removed from the holding shaft 71 when the holding shaft 71 is moved from the clamp position to an unclamp position by the releasing mechanism 8.

The structure of the releasing mechanism 8 is now described. As shown in FIGS. 3 and 4, the releasing mechanism 8 of the present embodiment mainly includes the release lever 8 and a biasing spring 83.

The release lever 81 is supported by the housing 10 so as to be turned by a user. In the present embodiment, the release lever 81 is formed by an upper member 811 and a lower member 815. The upper member 811 is disposed on a top surface of the front end portion of the housing 10. The lower member 815 is connected to the upper member 811 and protrudes downward. The upper member 811 includes a base part 812 having a circular shape in a plan view and a lever part 813 protruding from the base part 812 substantially in a normal direction. The lower member 815 is configured as a stepped cylindrical member. An upper portion of the lower member 815 is configured as a small-diameter part having a smaller outer diameter, and fitted in a cylindrical hole formed in the base part 812. In the present embodiment, the upper member 811 and the lower member 815 are unrotatably fitted to each other and fixed by screws, in a state in which a cylindrical holding sleeve 87, which is s fixed to the housing 10, is held between the upper member 811 and the lower member 815 in the up-down direction. With such a structure, the upper member 811 and the lower member 815 are integrated as the release lever 81 and supported rotatably around the driving axis A1 by the holding sleeve 87.

Figure 10:
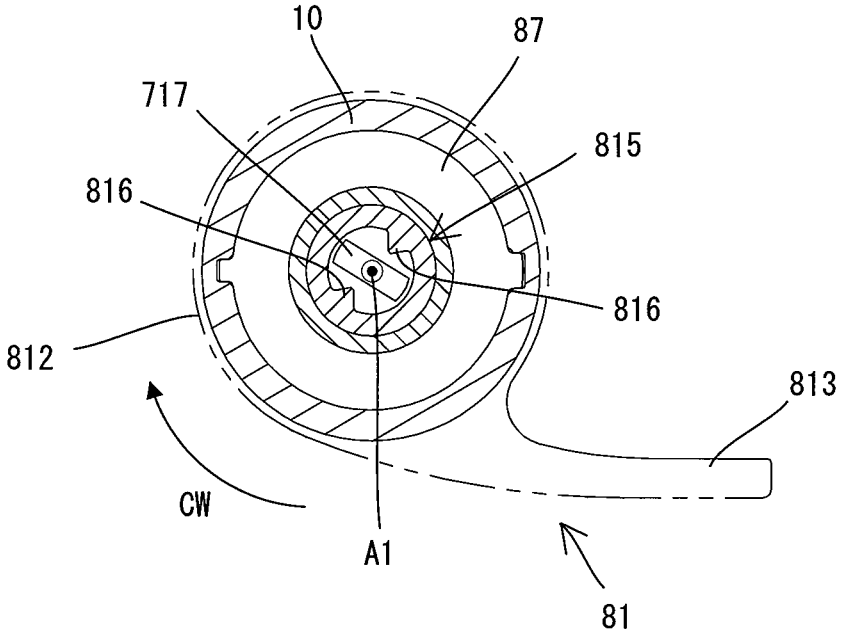
FIG. 10 is a sectional view taken along line X-X in FIG. 3, for illustrating the positional relationship between the release lever and the holding shaft when the release lever is located in an initial position and the holding shaft is located in the clamp position.

Further, as shown in FIG. 10, engagement parts 816 are formed on the inside of the lower member 815 at two positions in the circumferential direction around the driving axis A1. As shown in FIG. 3, when the holding shaft 71 is retained in the clamp position, the lever engagement part 717 protrudes upward from the spring receiving member 59 and is located within the lower member 815. The engagement parts 816 are each configured as a protruding part which can abut on a side surface of the lever engagement part 717 of the holding shaft 71.

Figure 11:
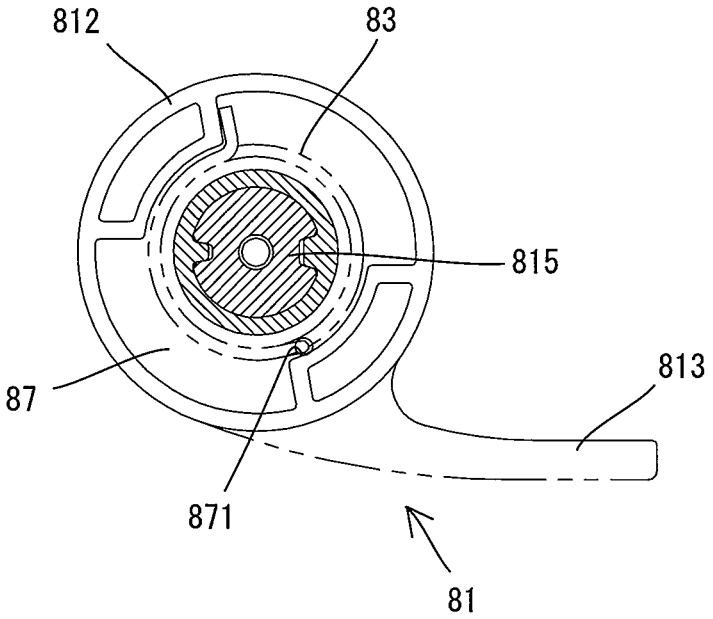
FIG. 11 is a sectional view taken along line XI-XI in FIG. 3.

In the present embodiment, a torsion coil spring is employed as the biasing spring 83. As shown in FIG. 3, the biasing spring 83 is mounted onto the holding sleeve 87 and a cylindrical portion of the base part 812. As shown in FIG. 11, a lower end portion (fixed end) of the biasing spring 83 is locked to a locking groove 871 formed in the holding sleeve 87, while an upper end portion (actuation end) of the biasing spring 83 is locked to the base part 812. The biasing spring 83 is assembled to the release lever 81 while being twisted in a clockwise direction when viewed from above (in other words, the biasing spring 83 is under load in the twisted direction). Thus, the release lever 81 is biased in a counterclockwise direction when viewed from above and held (retained) in a position (see FIG. 1) where the lever part 813 extends rearward and abuts on a left side surface of the housing 10. This position of the release lever 81 is hereinafter referred to as an initial position.

Operations of the holding mechanism 7 and the releasing mechanism 8 when removing and mounting the tool accessory 91 are now described.

First, removal of the tool accessory 91 is described.

As shown in FIGS. 3, 5, 7 and 10, when the release lever 81 is located in the initial position and the holding shaft 71 is located in the clamp position, the lever engagement part 717 of the holding shaft 71 is disposed in the inside of the lower member 815 of the release lever 81 without being pressed in the circumferential direction by the engagement parts 816. Further, as described above, the both end portions (the rollers 76) of the engagement pin 75 are engaged with the respective first parts 541 of the pin engagement grooves 54. Moreover, the locking part 67 is located in the lock position and the lower surface 673 is engaged with the bottom wall part 703 in surface contact with the upper surface 704, so that the clamp shaft 6 is connected to the holding shaft 71 via the locking part 67. Thus, the clamp shaft 6 is fixedly held relative to the spindle 5 in a state of being biased upward, and the tool accessory 91 is clamped by the tool mounting part 50 and the clamp head 63.

In this state, a user holds the lever part 813 and turns the release lever 81 from the initial position in a clockwise direction (shown by arrow CW in FIG. 10) against the biasing force of the biasing spring 83. In this process, the engagement parts 816 abut on the lever engagement part 717 and rotate the holding shaft 71 in the same direction as the release lever 81 (i.e. in the clockwise direction when viewed from above) against the biasing force of the biasing spring 77. The engagement pin 75 engaged with the first parts 541 of the pin engagement grooves 54 moves obliquely downward within the first parts 541 along with rotation of the holding shaft 71. At this time, the rollers 76 roll within the respective first parts 541, so that the engagement pin 75 is guided along the first part 541. Thus, the holding shaft 71 moves downward while rotating around the driving axis A1 relative to the spindle 5. A torsional force (torque) is applied to the biasing springs 83 and 77 along with rotation of the release lever 81 and the holding shaft 71.

Figure 12:
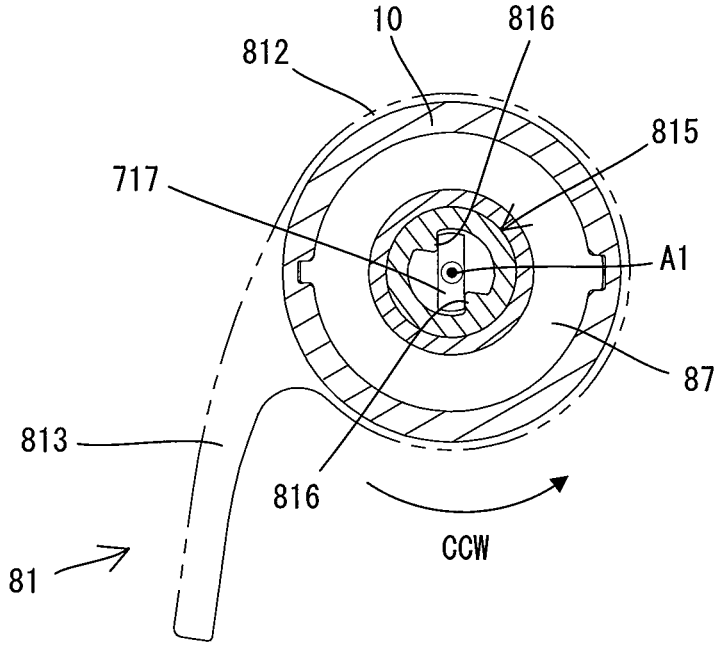
FIG. 12 is a sectional view similar to FIG. 10, for illustrating the positional relationship between the release lever and the holding shaft when the release lever is turned to a turned position and the holding shaft is located in the unclamp position.

As shown in FIG. 12, when the release lever 81 is turned to an approximately 90 degrees position (hereinafter referred to as a turned position) from the initial position in the clockwise direction, each of the end portions (the rollers 76) of the engagement pin 75 reaches a portion connecting from the first part 541 extending obliquely to the second part 542 extending in the up-down direction. At this time, the holding shaft 71 is biased downward by a restoring force of the biasing spring 77, which has been pre-compressed in the axial direction. The engagement pin 75 is engaged with the second parts 542 via the rollers 76, and guided downward along the second parts 542. It is noted here that the holding shaft 71 is also biased in the counterclockwise direction when viewed from above by the restoring force of the biasing spring 77 in the torsional direction, but prevented from rotating by engagement of the engagement pin 75 with the second parts 542 via the rollers 76. Therefore, the holding shaft 71 linearly moves downward.

Figure 9:
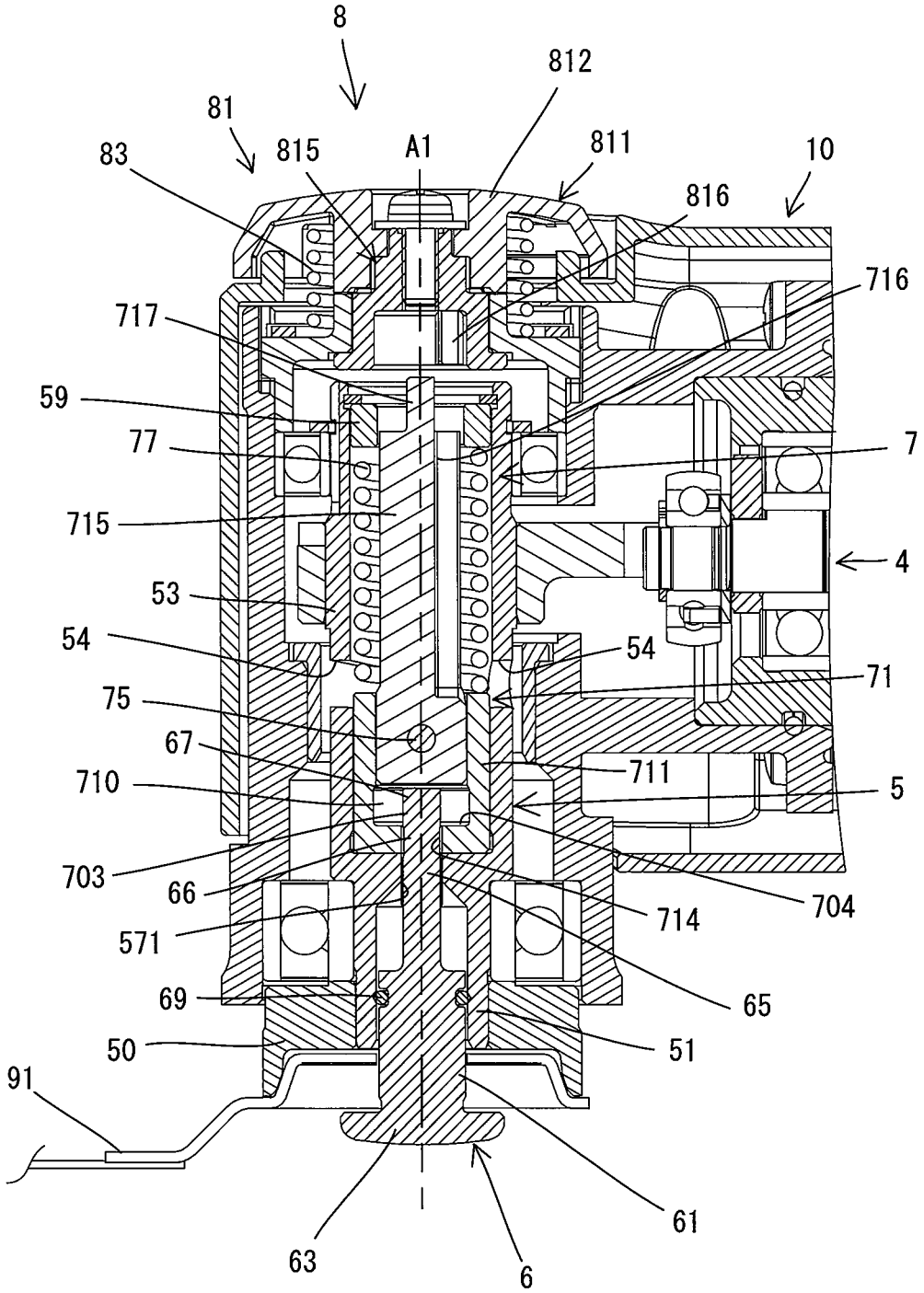
FIG. 9 is a partial sectional view similar to FIG. 3, showing the oscillating tool when the holding shaft is located in an unclamp position.
Figure 13:
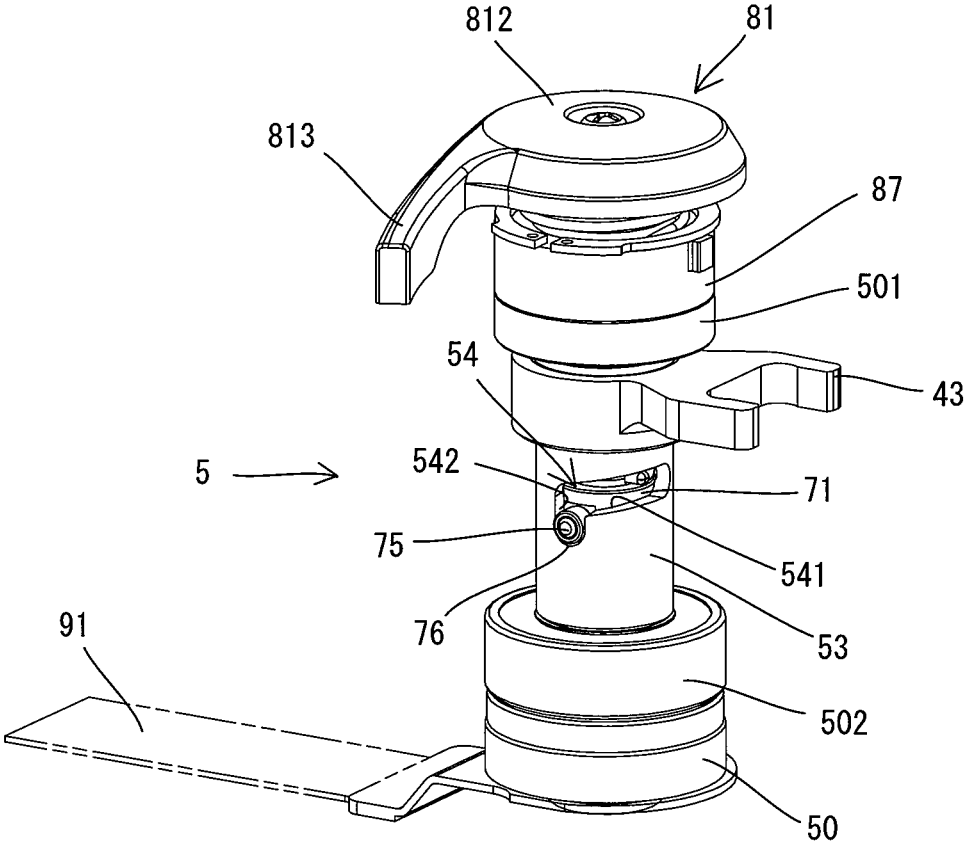
FIG. 13 is a perspective view showing the spindle, the holding shaft and the release lever when the holding shaft is located in the unclamp position.

As shown in FIG. 13, the holding shaft 71 moves to a position where the engagement pin 75 abuts on lower ends of the second parts 542, and is held in this position by the biasing force of the biasing spring 77 in the axial direction. This position of the holding shaft 71 is hereinafter referred to as an unclamp position. As shown in FIG. 9, in the unclamp position, the lever engagement part 717 of the holding shaft 71 is separated downward from the engagement parts 816 of the release lever 81.

When the release lever 81 is turned, the holding shaft 71 rotates around the driving axis A1 relative to the spindle 5, but the clamp shaft 6 is retained so as not to rotate relative to the spindle 5. Therefore, the position of the clamp shaft 6 in the circumferential direction relative to the holding shaft 71 changes. Further, in the present embodiment, the rotation angle (which has a plus value in the clockwise rotation) of the release lever 81 from the initial position to the turned position is approximately 90 degrees, while the rotation angle of the holding shaft 71 from the clamp position to the unclamp position, that is, the rotation angle of the locking part 67 from the unlock position to the lock position, is set to be within a range of about 30 to 60 degrees.

When the holding shaft 71 is rotated from the clamp position to the unclamp position, the clamp shaft 6 relatively moves from the lock position shown in FIG. 5 to the unlock position shown in FIG. 6, in which the locking part 67 is allowed to pass through the locking hole 714 of the holding shaft 71. Thus, the clamp shaft 6 is disengaged from the holding shaft 71 and allowed to move downward. In other words, clamping of the tool accessory 91 by the tool mounting part 50 and the clamp head 63 is released. At this time, the locking hole 714 and the positioning hole 571 of the spindle 5 are aligned with each other in the up-down direction. Therefore, the clamp shaft 6 is allowed to be removed (pulled out) from the holding shaft 71 and the spindle 5.

In the process in which the holding shaft 71 is moved from the clamp position to the unclamp position as the release lever 81 is turned, the lower end of the base shaft 701 abuts on an upper end of the locking part 67 and pushes the clamp shaft 6 downward. The clamp shaft 6 linearly moves downward without rotating since it is prevented from rotating as described above. At this time, the frictional force of the elastic member 69 fitted onto the outer periphery of the shaft part 61 prevents the clamp shaft 6 from dropping by its own weight while sliding within the small-diameter part 51. Even when the holding shaft 71 reaches the unclamp position, as shown in FIG. 9, the clamp shaft 6 is held inserted in the small-diameter part 51. In this state, the user can remove the tool accessory 91 by pulling the clamp shaft 6 out of the spindle 5 and the holding shaft 71 together with the tool accessory 91.

Figure 14:
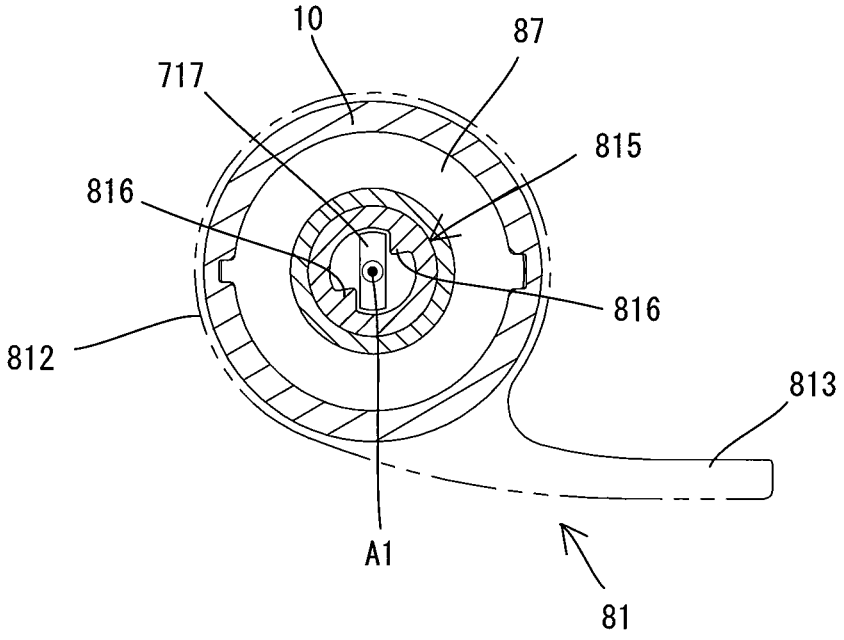
FIG. 14 is a sectional view similar to FIG. 10, for illustrating the positional relationship between the release lever and the holding shaft when the release lever is returned to the initial position while the holding shaft is located in the unclamp position.

When the user releases the lever part 813 in a state in which the holding shaft 71 is located in the unclamp position, the release lever 81 turns toward the initial position in the counterclockwise direction (shown by arrow CCW in FIG. 12) by a restoring force corresponding to the torsional force which was applied to the biasing spring 83 when the release lever 81 was turned to the turned position. At this time, as described above, the lever engagement part 717 of the holding shaft 71 is separated downward from the engagement parts 816 of the release lever 81 (see FIG. 9). Further, the holding shaft 71 is prevented from rotating by engagement of the end portions (the rollers 76) of the engagement pin 75 with the respective second parts 542 of the pin engagement grooves 54. Therefore, as shown in FIG. 14, even if the release lever 81 returns to the initial position, the holding shaft 71 is held in the unclamp position without rotating. As a result, the user can easily remove the clamp shaft 6 and the tool accessory 91 after releasing the release lever 81.

Next, mounting of the tool accessory 91 is described.

In the state before mounting the tool accessory 91, as described above, the holding shaft 71 is held in the unclamp position by the biasing force of the biasing spring 77 in the axial direction, with the clamp shaft 6 removed. A user first selects one of the tool accessories 91 for a desired operation and inserts the clamp shaft 6 through a through hole formed in the central portion of the protruding part 911 of the tool accessory 91. Then, the user adjusts the position of the clamp shaft 6 in the circumferential direction relative to the spindle 5 and the holding shaft 71, and inserts the clamp shaft 6 into the spindle 5 and the holding shaft 71 from the locking part 67 side. Specifically, the user positions the clamp shaft 6 such that the locking part 67 and the positioning part 65 are allowed to pass through the positioning hole 571 of the spindle 5 and the locking part 67 is allowed to pass through the locking hole 714 of the holding shaft 71. In the unclamp position, as described above, the holding shaft 71 is held so as not to rotate relative to the spindle 5, and the positioning hole 571 and the locking hole 714 are aligned with each other in the up-down direction. Therefore, the positioning in this case means placing the locking part 67 in the unlock position in the circumferential direction.

When the clamp shaft 6 is placed in the unlock position and moved upward relative to the spindle 5 and the holding shaft 71, as shown in FIG. 9, the locking part 67 is inserted into the space 710 of the lower end portion of the holding shaft 71, through the locking hole 714. Then, the upper end of the locking part 67 abuts on the lower end of the base shaft 701 and pushes the holding shaft 71 upward against the axial biasing force of the biasing spring 77. The engagement pin 75 (see FIG. 13) engaged with the second parts 542 via the rollers 76 moves upward within the second parts 542, toward the portions which connect to the respective first parts 541.

When the engagement pin 75 reaches the portions each connecting from the second part 542 to the first part 541, the holding shaft 71 rotates relative to the spindle 5 in the counterclockwise direction when viewed from above, by the restoring force corresponding to the torsional force which was applied to the biasing spring 77 when the release lever 81 was turned to the turned position. At this time, the engagement pin 75 moves obliquely upward within the first parts 541. Then, the engagement pin 75 (the rollers 76) is engaged with the first parts 541 (the inclined surfaces) at the position where the torsional force and the axial force are balanced, and the holding shaft 71 is returned to the clamp position and held in this position.

Meanwhile, the clamp shaft 6 is prevented from rotating relative to the spindle 5 since the positioning part 65 is disposed within the positioning hole 571. Therefore, when the holding shaft 71 rotates around the driving axis A1 relative to the spindle 5, the position of the locking part 67 in the circumferential direction relative to the holding shaft 71 changes from the unlock position (see FIG. 6) to the lock position (see FIG. 5). As a result, the locking part 67 is engaged with the holding shaft 71 and thus the clamp shaft 6 is connected to the holding shaft 71. Therefore, when the holding shaft 71 returns to the clamp position, the clamp shaft 6 is fixedly held relative to the spindle 5 while being biased upward, so that the tool accessory 91 is clamped by the tool mounting part 50 and the clamp head 63.

As described above, the oscillating tool 1 of the present embodiment is configured to oscillatorily drive around the driving axis A1 the tool accessory 91 which is clamped by the tool mounting part 50 of the spindle 5 and the clamp head 63 of the clamp shaft 6. The clamp shaft 6 is connected to the holding shaft 71 via the locking part 67, and fixedly held relative to the spindle 5 by the holding shaft 71 which is biased upward by the biasing spring 77. More specifically, the locking part 67 is configured to rotate between the unlock position and the lock position around the driving axis A1 relative to the holding shaft 71. In the unlock position, in which the locking part 67 is allowed to pass through the locking hole 714 of the holding shaft 71, the locking part 67 allows the clamp shaft 6 to move in the up-down direction relative to the holding shaft 71. On the other hand, in the lock position, in which the locking part 67 is engaged with the holding shaft 71, the locking part 67 prevents the clamp shaft 6 from moving downward relative to the holding shaft 71.

In the oscillating tool 1 having such a structure, the state of the clamp shaft 6 held (retained) by the holding shaft 71 can be switched simply by rotating the holding shaft 71 and the locking part 67 relative to each other to change the position of the locking part 67 relative to the holding shaft 71 between the unlock position and the lock position.

Therefore, compared with a conventional structure in which a ball (balls) or a clamp member (clamp members) which holds (hold) the clamp shaft is (are) moved in the radial direction, a space required in the radial direction can be minimized. Particularly, in the present embodiment, the locking part 67 is integrally formed with the shaft part 61 of the clamp shaft 6. This eliminates the need for separately providing an engagement member which is configured to be engaged with the holding shaft 71 to connect the clamp shaft 6 to the holding shaft 71 within the housing 10. Thus, the structure can be simplified and ease of assembly can be enhanced.

In the present embodiment, the locking hole 714 of the holding shaft 71 is configured as a through hole extending through the bottom wall part (lower wall part) 703 in the up-down direction and having a closed periphery. The locking part 67 is configured to be engaged in surface contact with a region of the upper surface 704 of the bottom wall part 703 around the locking hole 714, when the locking part 67 is placed in the lock position. Stable engagement between the locking part 67 and the holding shaft 71 can be ensured by such surface contact, compared with line contact or point contact. Furthermore, local wear of the lower surface 673 of the locking part 67 can be suppressed, so that durability of the locking part 67 is enhanced.

The locking part 67 has a pair of flat surfaces (side surfaces) opposed in parallel to each other across the driving axis A1, and the locking hole 714 has a cross-sectional shape which generally matches the locking part 67. With such a structure, the locking part 67 and the locking hole 714 can be easily manufactured. Further, the locking part 67 can be more reliably engaged with the holding shaft 71 at a relatively small angle of rotation relative to the holding shaft 71.

In the present embodiment, the holding shaft 71 is configured to move between the clamp position and the unclamp position relative to the spindle 5 (specifically, in the up-down direction and also in the circumferential direction) and held by the biasing force of the biasing spring 77 at either position. In other words, even if the release lever 81 is released, the holding shaft 71 does not automatically return to the clamp position. Then, when the shaft part 61 is inserted into the spindle 5 against the biasing force of the biasing spring 77 in a state in which the holding shaft 71 is in the unclamp position and the locking part 67 is in the unlock position, the holding shaft 71 moves toward the clamp position while rotating around the driving axis A1 and thus the locking part 67 relatively moves to the lock position. Therefore, only by an operation of inserting the shaft part 61 into the spindle 5 (in other words, by one-touch operation), the user can rotate the holding shaft 71 to relatively move the locking part 67 to the lock position and thereby fixedly hold the clamp shaft 6 relative to the spindle 5.

In the present embodiment, the biasing spring 77 has a function as a torsion spring and is configured to bias and rotate the holding shaft 71 around the driving axis A1 to thereby engage the engagement pin 75 with the first part 541 (inclined surface) of the pin engagement groove 54 and hold the holding shaft 71 in the clamp position. In other words, by utilizing the first part 541 inclined relative to the driving axis A1, the holding shaft 71 can be biased upward by the torsional force of the biasing spring 77 and held in the clamp position. Particularly, in the present embodiment, the inclination angle of the first part 541 relative to the imaginary plane orthogonal to the driving axis A1 is appropriately set such that the force is amplified. Further, with the structure in which the engagement pin 75 is engaged with the pin engagement groove 54 via the roller 76, movement of the holding shaft 71 is smoothly guided by the roller 76 rolling within the pin engagement groove 54.

The above-described embodiment is a mere example and a work tool according to the present invention is not limited to the structure of the oscillating tool 1 of the above-described embodiment. For example, the following changes or modifications may be made. One or more of these modifications may be employed in combination with any one of the oscillating tool 1 of the above-described embodiment and the claimed invention.

For example, the work tool may be embodied as a rotary tool (such as a grinder, a sander and a polisher) configured to rotationally drive the tool accessory 91.

The structures of the locking part 67 and the locking hole 714 may be appropriately modified. For example, the locking part 67 need not necessarily be integrally formed with the clamp shaft 6 (the shaft part 61). The locking part 67 may be formed as a separate member from the clamp shaft 6 and disposed within the spindle 5, as long as the locking part 67 can rotate around the driving axis A1 relative to the holding shaft 71 and allow movement of the clamp shaft 6 in the up-down direction in the unlock position, while preventing downward movement of the clamp shaft 6 in the lock position where the locking part 67 is engaged with the holding shaft 71 to connect the clamp shaft 6 and the holding shaft 71.

The shapes of the locking hole 714 and the locking part 67 are not limited to a shape of the elongated hole as shown in the above-described embodiment, but may be any shape as long as the locking part 67 can be engaged with a region around the locking hole 714 when the locking part 67 is rotated from the unlock position relative to the holding shaft 71. For example, any shape (such as an elliptical shape and a polygonal shape) other than a circular shape can be selected as the shapes of the locking part 67 and the locking hole 714 when viewed from above. In order to ensure reliable engagement between the locking part 67 and the holding shaft 71, it may be preferable that the locking part 67 is engaged in surface contact with the holding shaft 71 over a wider range when the locking part 67 is located in the lock position. A preferable angle range of rotation between the lock position and the unlock position may be appropriately set according to the shape of the locking hole 714 and the locking part 67. Further, as long as the locking hole 714 is a space (passage) through which the locking part 67 located in the unlock position is allowed to pass, the locking hole 714 may be configured, for example, as a recess having a cutout (opening) in the outer peripheral portion of the through hole, in place of the through hole having a closed periphery. The locking hole 714 and the locking part 67 need not necessarily have matching shapes.

In the above-described embodiment, the clamp shaft 6 is prevented from rotating around the driving axis A1 relative to the spindle 5 by the positioning hole 571. Further, when the release lever 81 is turned or the clamp shaft 6 is inserted, the holding shaft 71 is rotated, so that the locking part 67 is rotated relative to the holding shaft 71. On the contrary, however, it may be configured such that the holding shaft 71 is held by the spindle 5 while being prevented from rotating and the clamp shaft 6 is allowed to rotate relative to the holding shaft 71. In this case, for example, a user can relatively move the clamp shaft 6 to the lock position by inserting the clamp shaft 6 into the locking hole 714 with the locking part 67 in the unlock position and manually rotating the clamp shaft 6.

The biasing spring 77 for biasing the holding shaft 71 need not have both functions of a compression spring and a torsion spring, but, for example, an elastic element having only either one of the functions may be employed instead. For example, the elastic element having only the function of the compression spring may be configured to always bias the holding shaft 71 upward to hold the holding shaft 71 in the clamp position. In a case where the elastic element having only the function of a torsion spring is employed, the holding shaft 71 may be held in the clamp position by utilizing the engagement pin 75 and an inclined groove similar to the first part 541. In either case, a cam lever having an eccentric part may be employed, in place of the release lever 81, to move the holding shaft 71 downward against the biasing force of the elastic element and hold the holding shaft 71 in the unclamp position.

The elastic member 69 for preventing the clamp shaft 6 from dropping by its own weight when the locking part 67 is located in the unlock position need not have an annular shape. For example, elastic members may be mounted at a plurality of positions in the circumferential direction on the outer peripheral surface of the shaft part 61. Further, the elastic member 69 may be omitted.

The structure (for example, shape and support structure) of the spindle 5 is not limited to that of the above-described embodiment, and may be appropriately modified. For example, the spindle 5 may be formed by integrally connecting a plurality of members. In the above-described embodiment, the tool mounting part 50 has the recess 500 corresponding to the protruding part 911 of the tool accessory 91, and the tool accessory 91 is fixed to the tool mounting part 50 with the inclined surface of the tool accessory 91 in abutment with the inclined surface of the tool mounting part 50. However, the tool mounting part 50 may be configured to have a flat lower surface to which a tool accessory having a flat upper surface can be fixed. In this case, in order to position the tool accessory relative to the tool mounting part 50, the tool mounting part 50 and the tool accessory may have a protruding part and a fitting hole, respectively.

The structures of the housing 10, the motor 3 and the driving mechanism 4 may also be appropriately modified. For example, the housing 10 may be configured as a so-called vibration-isolating housing including an inner housing and an outer housing which are connected via one or more elastic members so as to be movable relative to each other. Further, for example, the motor 3 may be an alternate current (AC) motor. The motor 3 may be housed in the front end portion of the housing 10 such that the rotation axis A2 of the motor shaft 31 extends in parallel to the driving axis A1.

Correspondences between the features of the above-described embodiment and the features of the present disclosure are as follows. The oscillating tool 1 is an example that corresponds to the "work tool". The tool accessory 91 is an example that corresponds to the "tool accessory". The driving axis A1 is an example that corresponds to the "driving axis". The spindle 5 is an example that corresponds to the "spindle". The tool mounting part 50 is an example that corresponds to the "first clamp part". The clamp shaft 6 is an example that corresponds to the "clamp shaft". The shaft part 61 is an example that corresponds to the "shaft part". The clamp head 63 is an example that corresponds to the "second clamp part". The holding shaft 71 is an example that corresponds to the "holding member". The locking hole 714 is an example that corresponds to the "pass-through part". The locking part 67 is an example that corresponds to the "engagement member". The unlock position and the lock position are examples that correspond to the "first position" and the "second position", respectively. The biasing spring 77 is an example that corresponds to the "first biasing member".

The bottom wall part 703 is an example that corresponds to the "lower wall part". The upper surface 704 is an example that corresponds to the "upper surface of the lower wall part". The clamp position and the unclamp position are examples that correspond to the "holding position" and the "releasing position", respectively. The pin engagement groove 54 (specifically, the first part 541) is an example that corresponds to the "inclined groove". The engagement pin 75 is an example that corresponds to the "protruding part". The roller 76 is an example that corresponds to the "roller". The second part 542 is an example that corresponds to the "downward groove". The release lever 81 is an example that corresponds to the "operation member". The biasing spring 83 is an example that corresponds to the "second biasing member". The engagement part 816 is an example that corresponds to the "abutment part". The pair of flat surfaces 671 are an example that corresponds to the "pair of flat surfaces". The elastic member 69 is an example that corresponds to the "elastic member". The engagement part 816 is an example that corresponds to the "abutment part".

Further, in view of the nature of the present invention, the above-described embodiment and its modifications, the following features are provided. Each of the features can be employed independently or in combination with any one of the oscillating tool 1 of the embodiment, the above-described modifications and the claimed invention.

(Aspect 1)

The spindle includes a rotation preventing part which is configured to prevent the clamp shaft from rotating around the driving axis relative to the spindle.

Typically, the rotation preventing part is configured to prevent rotation of the clamp shaft by abutting on the clamp shaft. The pair of flat surfaces (wall surfaces of the partition wall 57) which define the front and rear ends of the positioning hole 571 are an example that corresponds to the "rotation preventing part" in the present aspect.

(Aspect 2)

The engagement member is provided on an upper end portion of the shaft part.

(Aspect 3)

The holding position and the releasing position are different from each other both in the up-down direction and in a circumferential direction around the driving axis.

(Aspect 4)

The biasing member is a coil spring having both functions of a compression spring and a torsion spring, and the biasing member is configured to bias the holding member downward relative to the spindle by a restoring force corresponding to compression of the coil spring when the holding member is located in the releasing position, and to bias the holding member upward relative to the spindle by a restoring force corresponding to torsion of the coil spring when the holding member is located in the holding position.

(Aspect 5)

The spindle has a downward groove extending downward from a lower end of the inclined groove, and the protruding part is configured to be engaged with the downward groove when the holding member is located in the releasing position, thereby preventing the holding member from rotating relative to the spindle.

(Aspect 6)

The spindle has a downward groove extending downward from a lower end of the inclined groove, and the protruding part is configured to be moved downward along the downward groove by a restoring force corresponding to compression of the biasing spring when the protruding part is moved to a portion connecting from the inclined groove to the downward groove, thereby guiding the holding member downward.

(Aspect 7)

The work tool further includes:

an operation member configured to move the holding member from the holding position to the releasing position by rotating the holding member around the driving axis according to a user's operation of the operation member, and a second biasing member configured to bias the operation member, wherein:

the second biasing member is configured to bias the operation member to be returned to an initial position in a state in which the holding member is held in the releasing position.

The release lever 81 is an example that corresponds to the "operation member" according to the present aspect. The biasing spring 83 is an example that corresponds to the "second biasing member" according to the present aspect.

(Aspect 8)

The operation member has an abutment part configured to abut on the holding member and rotate the holding member, and the holding member is configured to be separated from the abutment part when located in the releasing position.

The engagement part 816 is an example that corresponds to the "abutment part" according to the present aspect.

DESCRIPTION OF THE NUMERALS

1: oscillating tool, 10: housing, 13: grip part, 15: switch, 17: battery mounting part, 3: motor, 31: motor shaft, 4: driving mechanism, 41: eccentric shaft, 411: eccentric part, 43: oscillating arm, 45: drive bearing, 5: spindle, 50: tool mounting part, 500: recess, 501: bearing, 502: bearing, 51: small-diameter part, 53: large-diameter part, 531: locking groove, 54: pin engagement groove, 541: first part, 542: second part, 57: partition wall, 571: positioning hole, 59: spring receiving member, 591: retaining ring, 6: clamp shaft, 61: shaft part, 63: clamp head, 65: positioning part, 651: plane, 66: neck part, 67: locking part, 671: plane, 673: lower surface, 69: elastic member, 7: holding mechanism, 701: base shaft, 702: cylindrical member, 703: bottom wall part, 704: upper surface, 71: holding shaft, 710: space, 711: large-diameter part, 713: through hole, 714: locking hole, 715: small-diameter part, 716: locking groove, 717: lever engagement part, 75: engagement pin, 76: roller, 77: biasing spring, 8: releasing mechanism, 81: release lever, 811: upper member, 812: base part, 813: lever part, 815: lower member, 816: engagement part, 83: biasing spring, 87: holding sleeve, 871: locking groove, 91: tool accessory, 911: protruding part, 93: battery, A1: driving axis, A2: rotation axis

What is claimed is:

1. A work tool configured to perform an operation on a workpiece by driving a tool accessory, the work tool comprising:

a spindle supported to be rotatable around a driving axis and having a first clamp part on its lower end portion, the driving axis defining an up-down direction of the work tool;

a clamp shaft having a shaft part and a second clamp part, the shaft part being configured to be coaxially inserted into the spindle, the second clamp part being provided on a lower end portion of the shaft part and configured to clamp the tool accessory in cooperation with the first clamp part;

a holding member having a pass-through part;

an engagement member configured to be rotatable around the driving axis relative to the holding member between a first position and a second position, the engagement member in the first position being allowed to pass through the pass-through part, and the engagement member in the second position being not allowed to pass through the pass-through part and being engaged with the holding member; and a first biasing member configured to bias the holding member, wherein:

the engagement member is configured to allow the clamp shaft to move in the up-down direction relative to the holding member when located in the first position, and to prevent the clamp shaft from moving downward relative to the holding member when located in the second position;

the holding member is configured to fixedly hold the clamp shaft relative to the spindle while being biased upward by the first biasing member, with the engagement member in the second position;

the holding member has a lower wall part;

the pass-through part is formed as a through hole extending through the lower wall part in the up-down direction and having a closed periphery; and the engagement member is configured to come into surface contact with a portion of an upper surface of the lower wall part when located in the second position.

2. The work tool as defined in claim 1, wherein the engagement member is integrally formed with the shaft part.

3. The work tool as defined in claim 2, wherein the engagement member is provided on an upper end portion of the shaft part.

4. The work tool as defined in claim 1, wherein:

the engagement member has a pair of flat surfaces opposed in parallel to each other across the driving axis, and the pass-through part has a sectional shape substantially matching the engagement member.

5. The work tool as defined in claim 1, further comprising an elastic member disposed on an outer periphery of the shaft part and configured to come into frictional contact with an inner peripheral surface of the spindle when the shaft part is placed inside the spindle.

6. The work tool as defined in claim 1, wherein the spindle includes a rotation preventing part configured to prevent the clamp shaft from rotating around the driving axis relative to the spindle.

7. A work tool configured to perform an operation on a workpiece by driving a tool accessory, the work tool comprising:

a spindle supported to be rotatable around a driving axis and having a first clamp part on its lower end portion, the driving axis defining an up-down direction of the work tool;

a clamp shaft having a shaft part and a second clamp part, the shaft part being configured to be coaxially inserted into the spindle, the second clamp part being provided on a lower end portion of the shaft part and configured to clamp the tool accessory in cooperation with the first clamp part;

a holding member having a pass-through part;

an engagement member configured to be rotatable around the driving axis relative to the holding member between a first position and a second position, the engagement member in the first position being allowed to pass through the pass-through part, and the engagement member in the second position being not allowed to pass through the pass-through part and being engaged with the holding member; and a first biasing member configured to bias the holding member, wherein:

the engagement member is configured to allow the clamp shaft to move in the up-down direction relative to the holding member when located in the first position, and to prevent the clamp shaft from moving downward relative to the holding member when located in the second position;

the holding member is configured to fixedly hold the clamp shaft relative to the spindle while being biased upward by the first biasing member, with the engagement member in the second position;

the holding member is configured to move relative to the spindle between a holding position and a releasing position, the holding member in the holding position fixedly holding the clamp shaft relative to the spindle, and the holding member in the releasing position allowing removal of the clamp shaft from the spindle;

the holding member is configured to be held by a biasing force of the first biasing member when located in either the holding position or the releasing position; and the holding member is configured to move toward the holding position while rotating around the driving axis, when the shaft part is inserted into the spindle with the holding member in the releasing position and the engagement member in the first position, thereby causing the engagement member to relatively move to the second position.

8. The work tool as defined in claim 7, wherein the holding position and the releasing position are different from each other both in the up-down direction and in a circumferential direction around the driving axis.

9. The work tool as defined in claim 7, wherein:

the spindle has an inclined groove in its outer periphery, the inclined groove being inclined relative to the driving axis, the holding member has a protruding part disposed within the inclined groove, and the first biasing member has a function as a torsion spring and is configured to bias and rotate the holding member around the driving axis to thereby engage the protruding part with the inclined groove and hold the holding member in the holding position.

10. The work tool as defined in claim 9, wherein:

the holding member has a roller rotatably mounted onto the protruding part, and the protruding part is engaged with the inclined groove via the roller.

11. The work tool as defined in claim 9, wherein:

the first biasing member is a coil spring having both functions of a compression spring and a torsion spring, and the first biasing member is configured to bias the holding member downward relative to the spindle by a restoring force corresponding to compression of the coil spring when the holding member is located in the releasing position, and to bias the holding member upward relative to the spindle by a restoring force corresponding to torsion of the coil spring when the holding member is located in the holding position.

12. The work tool as defined in claim 11, wherein:

the spindle has a downward groove extending downward from a lower end of the inclined groove, and the protruding part is configured to be engaged with the downward groove when the holding member is located in the releasing position, thereby preventing the holding member from rotating relative to the spindle.

13. The work tool as defined in claim 11, wherein:

the spindle has a downward groove extending downward from a lower end of the inclined groove, and the protruding part is configured to be moved downward along the downward groove by the restoring force corresponding to compression of the first biasing spring when the protruding part is moved to a portion connecting from the inclined groove to the downward groove, thereby guiding the holding member downward.

14. The work tool as defined in claim 7, further comprising:

an operation member configured to move from an initial position according to a user's operation of the operation member to rotate the holding member around the driving axis, thereby moving the holding member from the holding position to the releasing position, and a second biasing member configured to bias the operation member toward the initial position, wherein:

the second biasing member is configured to bias the operation member to be returned to the initial position in a state in which the holding member is held in the releasing position.

15. The work tool as defined in claim 14, wherein:

the operation member has an abutment part configured to abut on the holding member and rotate the holding member, and the holding member is configured to be separated from the abutment part when located in the releasing position.

16. The work tool as defined in claim 7, wherein the engagement member is integrally formed with the shaft part.

17. The work tool as defined in claim 16, wherein the engagement member is provided on an upper end portion of the shaft part.

18. The work tool as defined in claim 7, wherein:

the engagement member has a pair of flat surfaces opposed in parallel to each other across the driving axis, and the pass-through part has a sectional shape substantially matching the engagement member.

19. The work tool as defined in claim 7, further comprising an elastic member disposed on an outer periphery of the shaft part and configured to come into frictional contact with an inner peripheral surface of the spindle when the shaft part is placed inside the spindle.

20. The work tool as defined in claim 7, wherein the spindle includes a rotation preventing part configured to prevent the clamp shaft from rotating around the driving axis relative to the spindle.

* * * * *